US006923137B2

(12) United States Patent
Waits, Jr.

(10) Patent No.: US 6,923,137 B2
(45) Date of Patent: Aug. 2, 2005

(54) WATER SPORTS PERFORMANCE BOAT HULL

(75) Inventor: William F. Waits, Jr., Oviedo, FL (US)

(73) Assignee: Correct Craft, Inc., Orlando, FL (US)

( * ) Notice: Subject to any disclaimer, the term of this patent is extended or adjusted under 35 U.S.C. 154(b) by 0 days.

(21) Appl. No.: 10/458,664

(22) Filed: Jun. 10, 2003

(65) Prior Publication Data

US 2003/0226491 A1 Dec. 11, 2003

Related U.S. Application Data

(60) Provisional application No. 60/387,471, filed on Jun. 10, 2002.

(51) Int. Cl.[7] ..... B63B 1/32

(52) U.S. Cl. ..... 114/288; 114/61.32; 114/291; 440/69

(58) Field of Search ..... 114/271, 288–291, 114/56.1, 61.32, 61.33; 440/68, 69; D12/310–314

(56) References Cited

U.S. PATENT DOCUMENTS

| | | | | | |
|---|---|---|---|---|---|
| 3,450,085 | A | * | 6/1969 | Van Patten | 114/290 |
| 3,977,347 | A | * | 8/1976 | With | 114/291 |
| 4,233,920 | A | * | 11/1980 | Wood et al. | 114/291 |
| 4,392,448 | A | * | 7/1983 | Shirley | 114/271 |
| 4,619,215 | A | * | 10/1986 | Wood et al. | 114/61.33 |
| 4,903,626 | A | * | 2/1990 | Haines | 114/291 |
| 5,031,556 | A | * | 7/1991 | Blee | 114/61.33 |
| D320,376 | S | * | 10/1991 | Livingston et al. | D12/314 |
| D347,616 | S | * | 6/1994 | Wenstadt et al. | D12/313 |
| 5,351,642 | A | * | 10/1994 | Ackerbloom | 114/291 |
| 5,390,624 | A | * | 2/1995 | Barnes | 114/288 |
| D360,180 | S | * | 7/1995 | Rolland et al. | D12/314 |
| 5,443,026 | A | * | 8/1995 | Wenstadt et al. | 114/61.33 |
| 5,718,184 | A | * | 2/1998 | Holland | 114/271 |
| 6,213,824 | B1 | * | 4/2001 | Small | 440/68 |
| 6,216,622 | B1 | * | 4/2001 | Lindstrom et al. | 114/61.33 |
| 6,406,341 | B1 | * | 6/2002 | Morejohn | 440/69 |

FOREIGN PATENT DOCUMENTS

| | | | | |
|---|---|---|---|---|
| FR | 2692543 A1 | * | 12/1993 | B63B/1/08 |
| JP | 57130880 A | * | 8/1982 | B63B/1/18 |

* cited by examiner

*Primary Examiner*—S. Joseph Morano
*Assistant Examiner*—Ajay Vasudeva
(74) *Attorney, Agent, or Firm*—Allen, Dyer, Doppelt, Milbrath & Gilchrist, P.A.

(57) ABSTRACT

A water sports performance boat includes a hull having a sharpened angle keel for cutting into the water. Reverse chines are carried on port and starboard sides and extending from a forward portion of the hull to an aft portion for inducing a lifting of the bow at generally low boat speeds and for providing a stabilizing effect. Port and starboard spray pockets are located at the aft portion of the hull for reducing a side spray of water near the transom. Performance strakes are formed within the hull with each extending from an aft position rearwardly to the transom. An elliptical shaped dispersion tunnel formed along the keel within an aft most portion of the hull extends through the transom and provides a desirable wake shape.

23 Claims, 6 Drawing Sheets

WATER SPORTS PERFORMANCE BOAT HULL

CROSS-REFERENCE TO RELATED APPLICATIONS

This application claims the benefit of U.S. Provisional Application No. 60/387,471, filed Jun. 10, 2002, the disclosure of which is herein incorporated by reference in its entirety.

FIELD OF THE INVENTION

The present invention relates to boat hulls and in particular to a hull operable for controlling a wake useful in performing water sports skills.

BACKGROUND OF THE INVENTION

There is an ever increasing need for a tow boat used in water sports to provide a wake having a shape desirable for various events including water skiing, wakeboarding, and the like and at various boat speeds.

SUMMARY OF THE INVENTION

A boat hull of the present invention may comprise a keel having a generally sharpened angle for cutting into water and directing flow toward starboard and port sides. Starboard and port side reverse chines extend from a forward portion of the hull to an aft portion for inducing a lifting of a bow at generally low boat speeds and for providing a stabilizing effect thereto during the towing of a performer. Such provides a desirable tracking capability of the hull during the to and fro maneuvering of the performer on and across a wake provided by the vessel. Spray pockets are formed proximate the reverse chines at an aft and outboard portion of the hull for reducing a side spray of water. A reduced side spray over typical hulls improves on the visibility of the performer to see buoy markers typically used during a performance. A plurality of strakes may be formed within the hull. Each of the plurality of strakes extends from an aft position rearwardly to the aft most location at the transom. A dispersion tunnel may extend along the keel within an aft most portion of the hull through the transom.

Embodiments may also include a step formed at each of an aft portion of the port and starboard reverse chines. The step includes a termination for relieving pressure from the reverse chine so as to provide an improved spray pattern of the resulting wake. The plurality of strakes may further comprise port and starboard primary strakes having a first length dimension and port and starboard secondary strakes having a second length dimension, and wherein the second length dimension may be less then the first length dimension. The primary strakes may be positioned out the secondary strakes.

A hull surface of the dispersion tunnel may be defined by an elliptical cross section so as to provide a desired rooster tail and bump to the wake. A strut supporting a shaft and extending from the hull may be rearwardly angled from a surface of the hull. One angle includes the axis extending from the hull surface at approximately twelve degrees from perpendicular. Further, aft most port and starboard portions of the hull may be tapered inwardly toward the keel for providing desired eddy currents.

One embodiment of a boat hull of the present invention may include the reversed chines, spray relief pockets, dispersion tunnel, and the strakes, that work in harmony to produce a flat and smooth wake desirable in water sports performance events. The embodiment herein described, by way of example, includes an independent multi-staged molded hull that provides the lift desired when towing a water sports performer riding and operating a wakeboard, by way of example. A wetted surface is provided that creates an enhanced wake at low speeds, and at higher speeds creates, thru independent lift forms, a hull form that enhances a slalom wake by the hull displacing less surface area and increasing lift.

Elements of the embodiments herein presented may further be described to include: Performance Strakes: Controlling surface pressure on the bottom of the boat improves performance. While typical stepped hull build pressure throughout the boat's length, the performance strakes lift the transom of the boat, which releases the water pressure that builds up along the surface of the hull. The water splits from the stem at a sharper angle, which creates a cleaner cut and a smoother ride. This also causes the wake to take on a flat, soft shape, making it easier for skiers and wake borders of all abilities to achieve their personal bests. Dispersion Tunnel: In like manner, the dispersion tunnel allows the water that has just been accelerated by the propeller to disperse in a controlled direction, which eliminates the dreaded "trough" well known to water sports performers. In addition, it drastically reduces and repositions the "rooster tail" so that it will not affect a skier's performance. Handling and Spray Relief Pockets: In addition to wake control, a desirable overall handling of the boat hull is achieved and the boat is nimble permitting a tighter turning radius, especially in high-speed turns. The spray relief pockets reverse the direction of water under the boat, which greatly reduces annoying water droplets typically pelting the performer in the face.

In combination, the above elements provide a smoother, more efficient ride, and an optimum wake for every performer, especially those over-achievers. Embodiments of the present invention may therefore include alone or in combination, an independent multi-staged molded hull lift design, a wetted hull surface to create an enhanced wakeboard wake at low speeds, and a hull which creates an improved lift to wetted hull surface at higher slalom speeds, thus displacing less water for an enhanced wake. Further enhancement may be gained from a strut angle to induce main bump from prop thrust to reenter wake at a more parallel angle. A dispersion tunnel allows high pressure from transom and prop trust to attach to tunnel molded surface, disperses at an elliptical angle, and softens wake bump and flattens wake. The dispersion tunnel creates lift at the trailing edge. Embodiments of the independent/multi-staged molded hull lift of the present invention produces a desirable attack angle for a hull at operating speeds.

BRIEF DESCRIPTION OF THE DRAWINGS

Features and benefits of the present invention will become apparent as the description proceeds when taken in conjunction with the accompanying drawing in which.

DETAILED DESCRIPTION OF THE PREFERRED EMBODIMENTS

Figure 1:
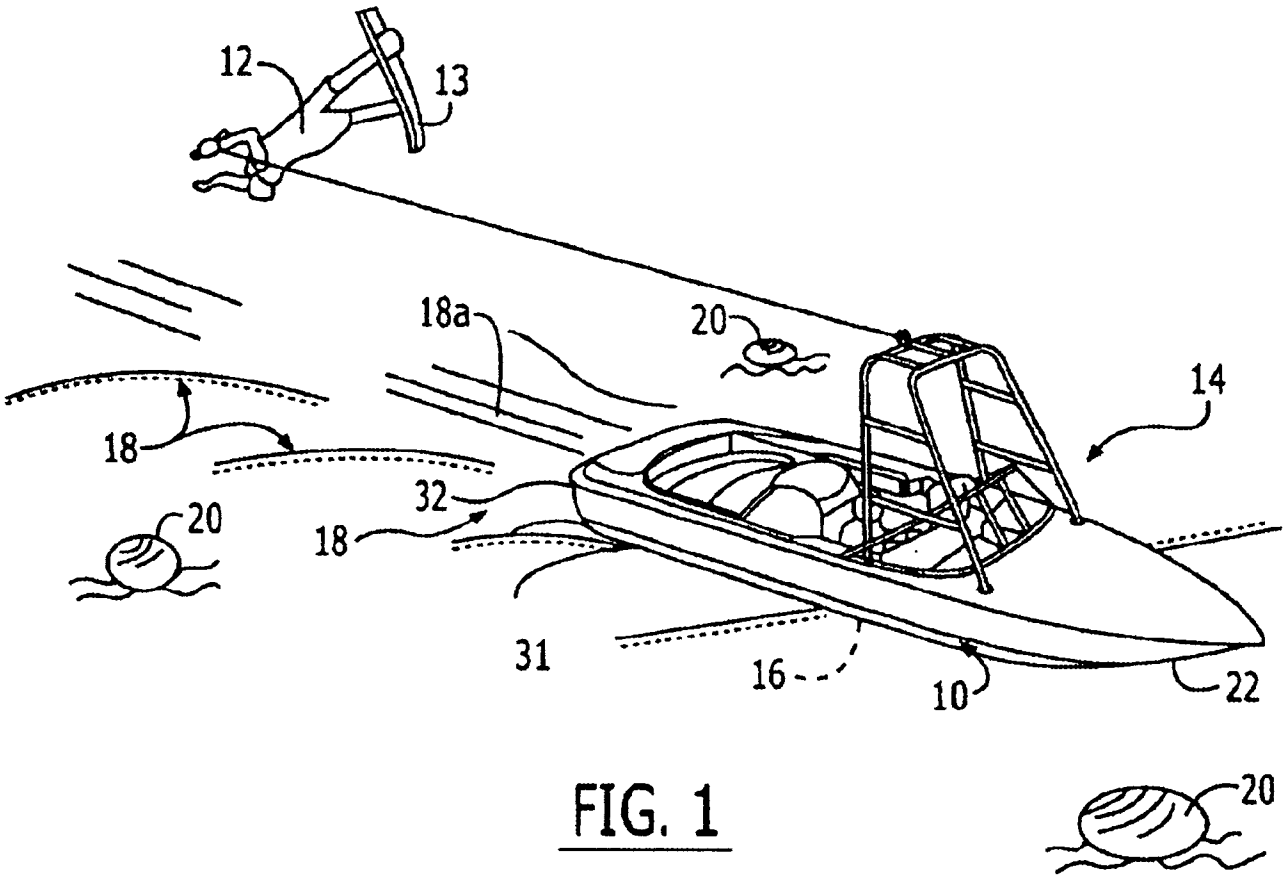
FIG. 1 is a partial perspective view of a boat towing a performer.

The present invention will now be described more fully hereinafter with reference to the accompanying drawings illustrating embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

By way of example, the embodiment herein described with reference to the accompanying drawings includes an independent multi-staged molded boat hull 10 that provides a lift desired when towing a water sports performer 12 riding and operating a wakeboard 13 or skis, behind a boat 14 as illustrated with reference to FIG. 1. Embodiments of the boat hull 10 provide a wetted surface 16 to create an enhanced wake 18 at low speeds, and at higher speeds create, thru independent lift elements herein later described in greater detail, a hull that enhances a slalom wake by the hull wetting less surface area and increasing lift. Such provides improved performance of the boat 14 and the performer 12 when negotiating the buoys 20 typically found in a slalom course.

Figure 2:
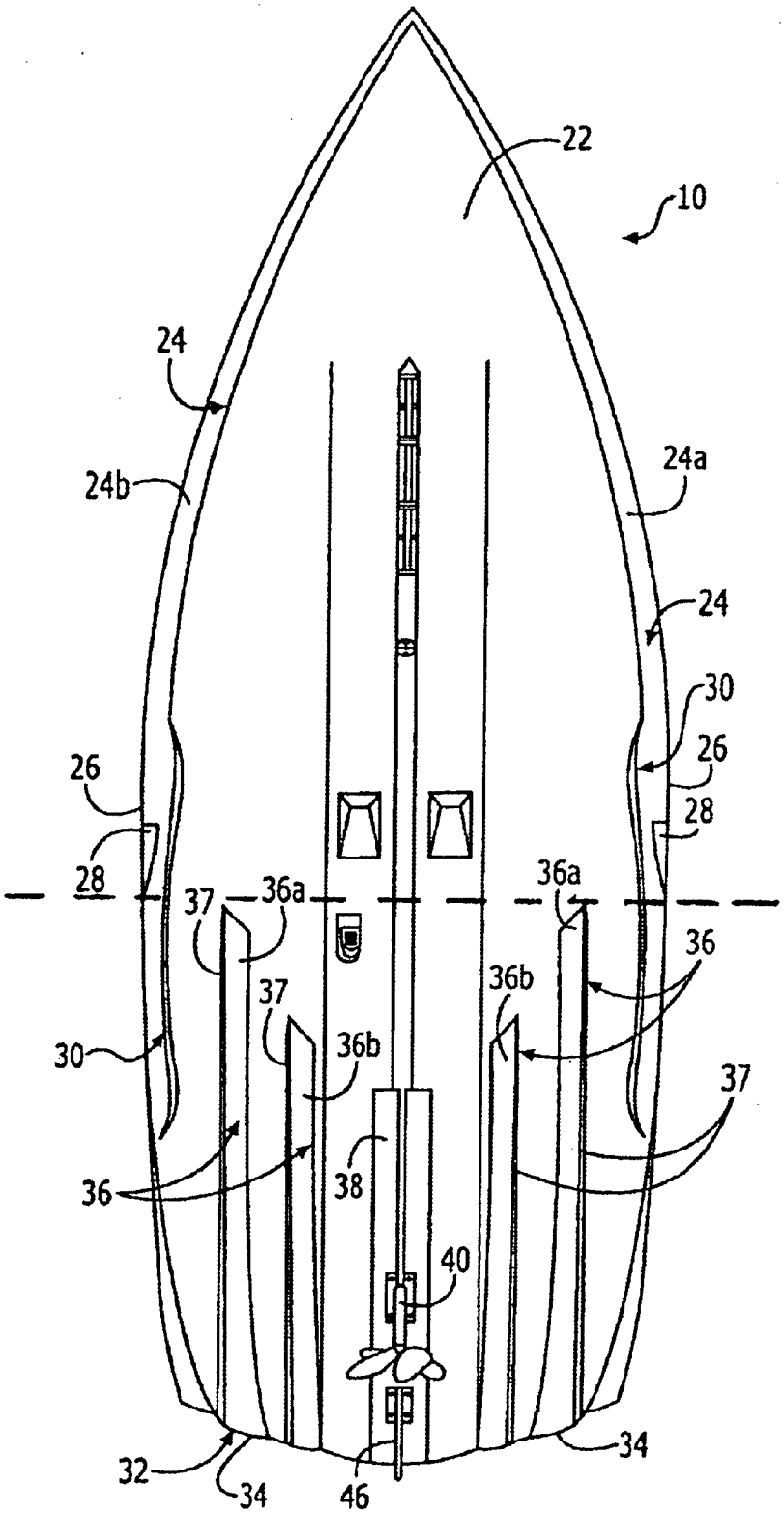
FIG. 2 is a bottom plan view a hull embodiment in keeping with the teachings of the present invention.
Figure 2A:
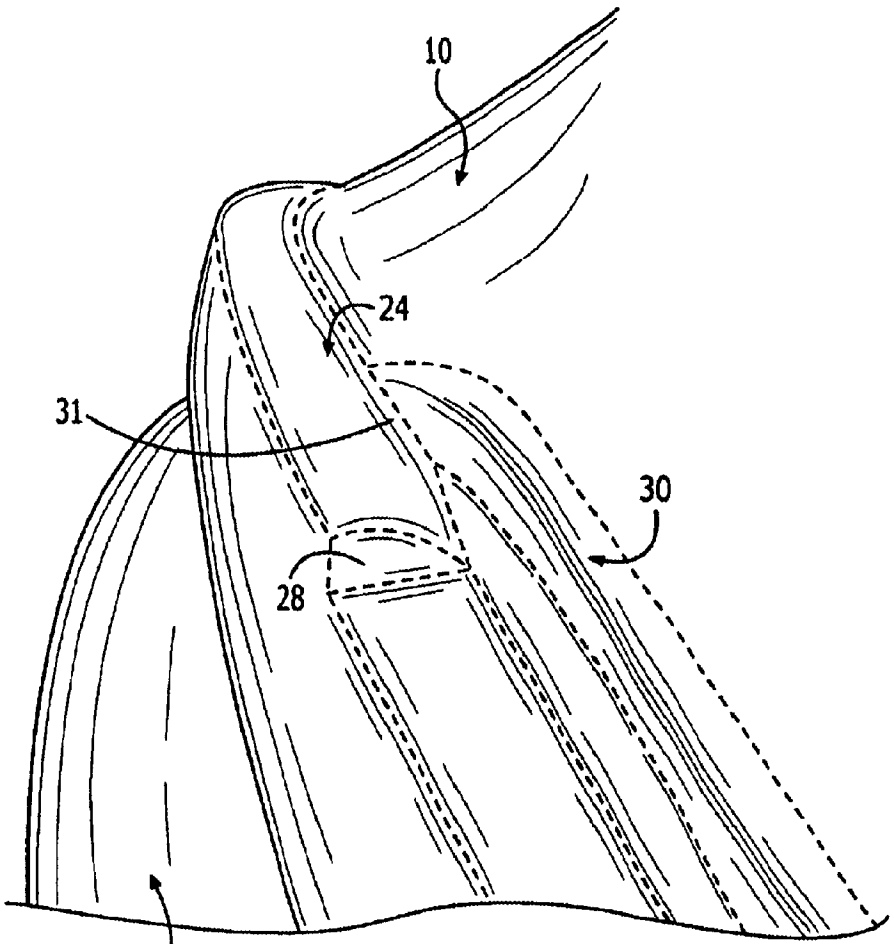
FIG. 2A is a partial enlarged perspective view of a starboard portion of the hull of FIG. 2.
Figure 3:
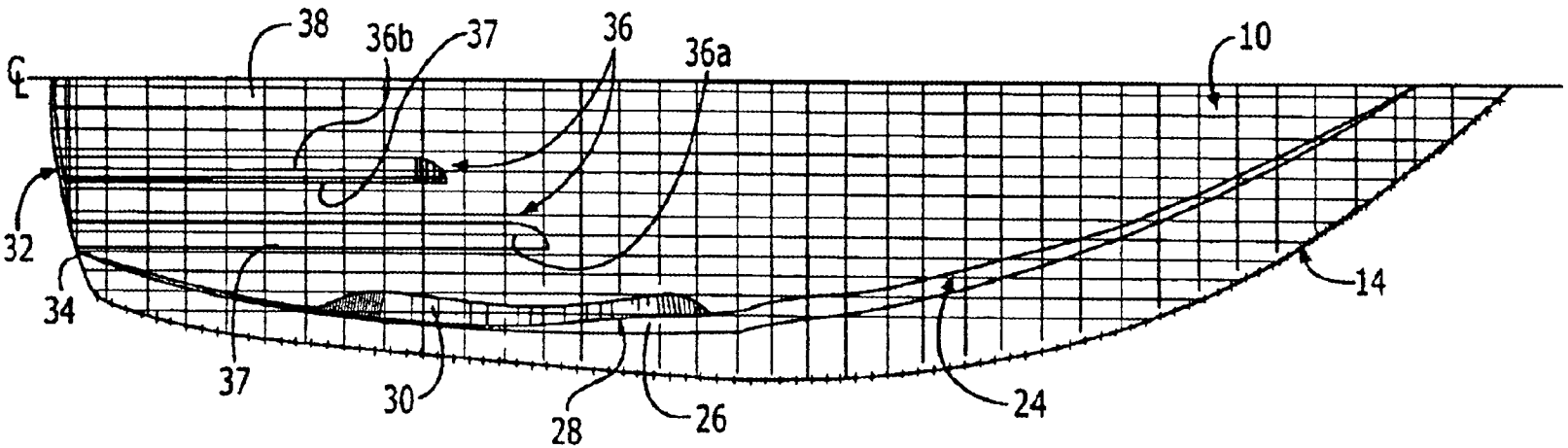
FIG. 3 is a partial bottom plan view of one hull embodiment.

With reference to FIGS. 2, 2A and 3 the boat hull 10 herein described by way of example includes a sharpened bow keel 22 to create ease in entrance into solid water by the boat 14. A reverse chine 24 is carried on both the port and starboard sides of the hull (24*a*, 24*b*) to induce a higher bow lift at slower speeds so as to create an enhanced trick and wakeboard wake 18 at slower speeds. The reverse chines 24 act as a stabilizer by allowing high pressure to channel down the port and starboard reverse chines 24*a*, 24*b* to create an equal stable lift allowing the boat 14 to track and drive a more precise path through the buoys 20. A trailing edge 26 of the reverse chines 24 is tapered, rolled, relieved, and generally flattened to allow the resulting wake 18 to have more of a cup shape on its lip with a sharpened crest at the top of the wake 18*a* to allow the performer on a wakeboard to have more lift from the resulting wake 18. A termination in the form of a step 28 relieves high pressure from the reverse chines 24 to create an improved side spray pattern and allow the boat 14 to create an independent lift at higher speeds with improved rear performance. As further illustrated with reference to the transverse line of FIG. 2, the strakes extend aft of the reverse chines 24 such that there is no overlapping of the strakes 36 with the reverse chines. Typically, boats may have a chine that runs bow to stern for creating diagonal lift and thus more friction and drag. The independent lift of the embodiment herein described lifts the hull 10 to create a desirable attack angle under increased speeds with the hull having less friction with less wetted surface allowing ease of boat handling.

With continued reference to FIGS. 1–3, spray pockets 30 carried on port and starboard sides of the hull 10 allow water to attach to the hull so as to lower and reduce side spray 31 at the transom 32. As illustrated with reference to FIG. 2A, the spray pocket 30 is formed within a generally horizontal portion of the hull 10 and disposed inwardly with respect to inner longitudinal edge 31 of the chine 24. Further, the spray pocket 30 is positioned entirely in a vertically spaced relation relative to the chine 24.

A port and starboard transom taper 34 allows the boat 14 to move thru the water more efficiently and creates less eddies and a lower more desirable skiing wake.

Performance strakes 36 including an elongate and step formation 37 create lift at higher speeds for improved performance while allowing the boat hull 10 to lift at higher speeds used in slalom skiing and to displace less water thus reducing the wake size at high boat speeds. The performance strakes 36, for the hull 10 herein described include port and starboard primary 36*a* and secondary 36*b* strakes.

A dispersion tunnel 38 allows water to attach to the hull 10 and relieves a high-pressure effect at the transom 32. An elliptical shape, for at least a portion 39 of the tunnel as herein described by way of example, reduces the familiar rooster tail and bump for the slalom skier thus enhancing the resulting performance.

Figure 4:
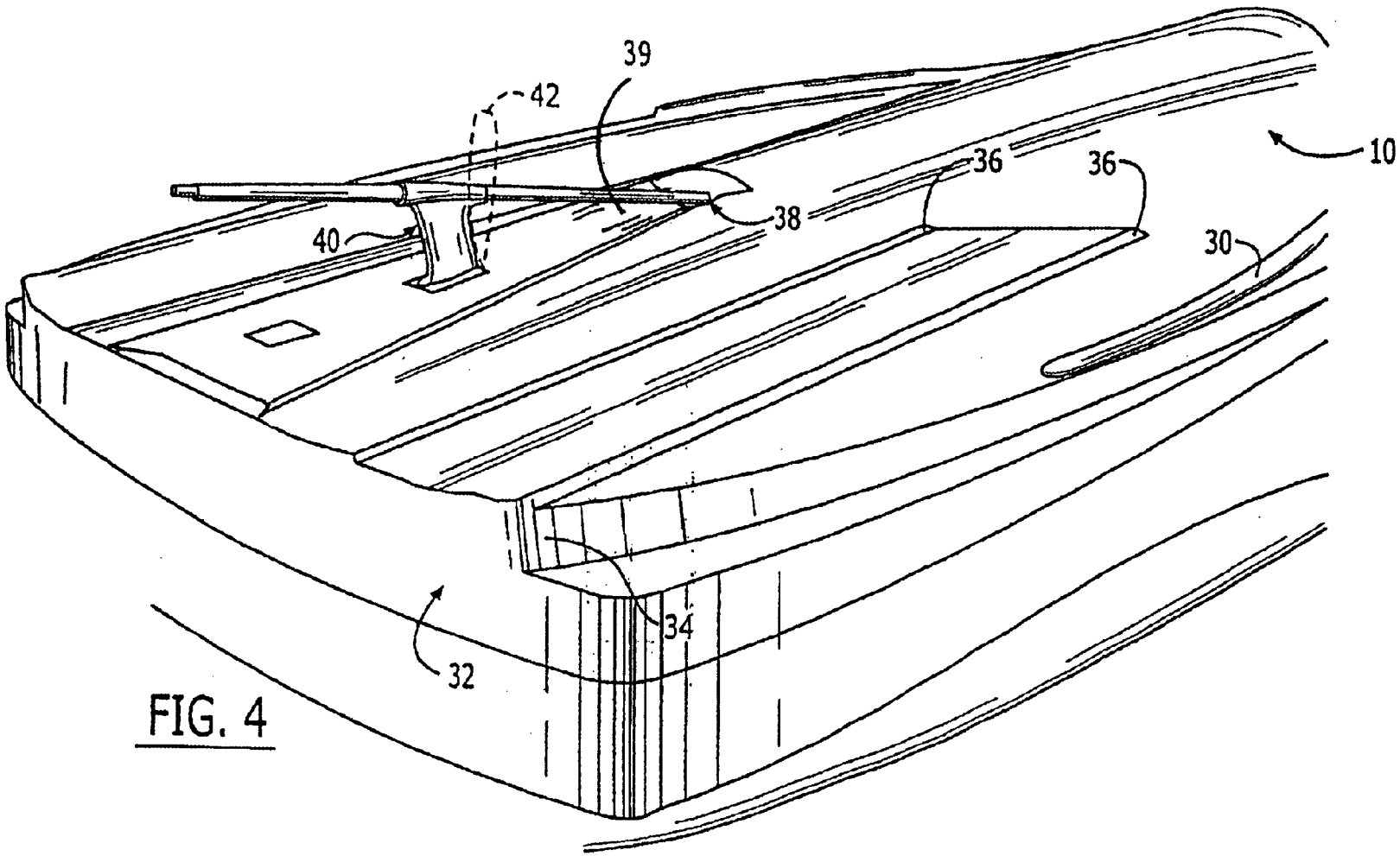
FIG. 4 is a port and aft perspective view of one hull embodiment seen in an overturned position.
Figure 5:
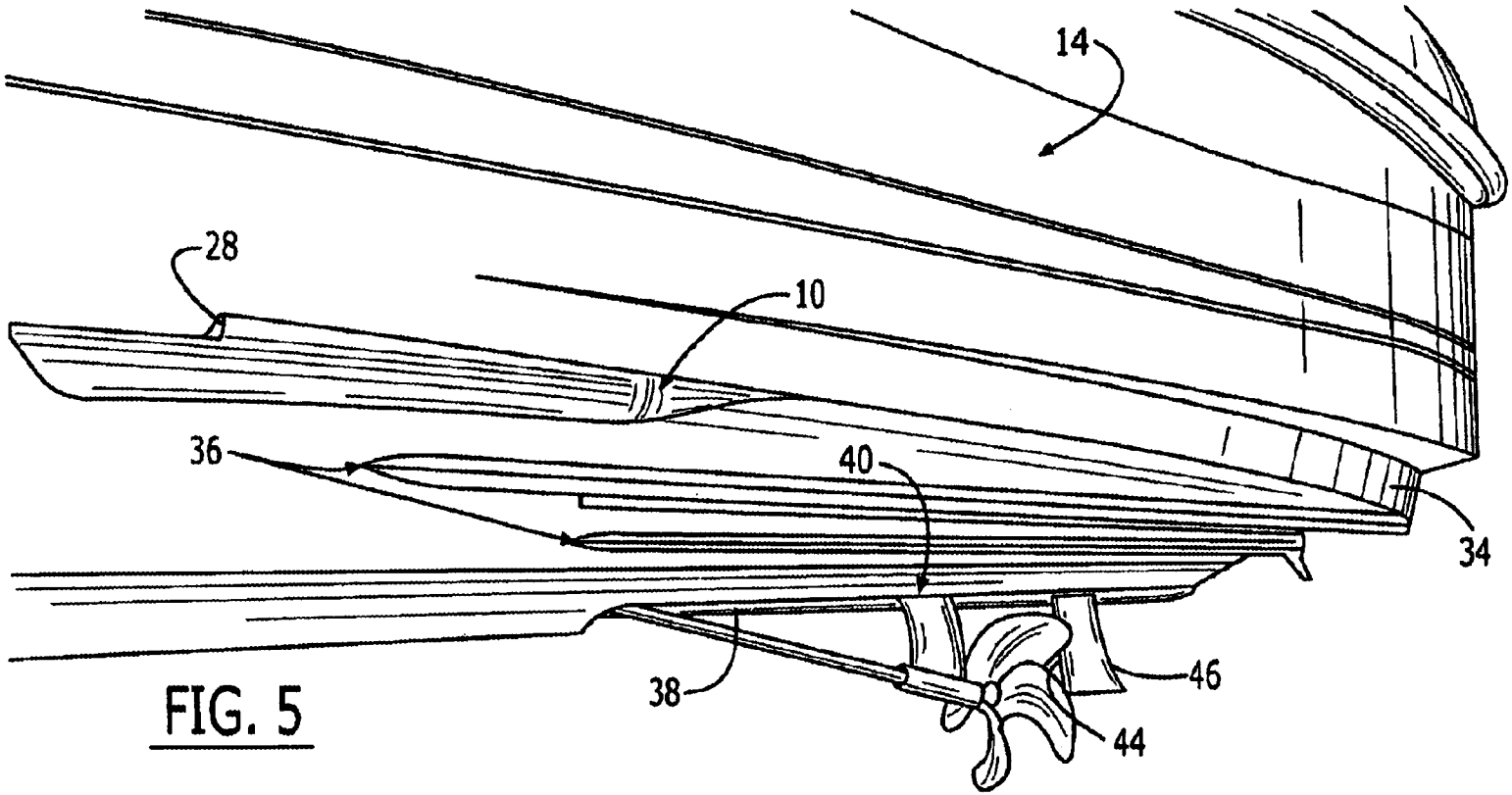
FIG. 5 is a side and aft perspective plan view of the propeller area portion the embodiment of FIG. 4.

A strut 40 is rearwardly angled to allow thrust generated by a propeller/prop 41 to be more parallel to the water surface during the generally angled hull position relative to the water surface during operation of the boat 14. This also lessens the bump or the rooster tail because the prop thrust will surface at a less severe angle. One embodiment includes a strut angle 42 of approximately twelve degrees as illustrated with reference to FIGS. 4 and 5.

Optionally, a leading edge 44 of a rudder 46 is tapered. The taper reduces eddies and noise from prop thrust.

A vacuum assisted molding process provides precise tooling procedures to create a predictable and repeatable hull 10 in the production process.

A laser alignment system (double end laser alignment system) places all underwater features and gear in the desired alignment with the engine and rudder for increased performance and reduced noise.

A boat hull herein described provides an optimum wake form for enhanced skier and wakeboard performance. The hull decreases depth and significance of port and starboard trough wake. Boat hull design also reduces the center of wake propeller thrust bump by allowing a skier to have a flatten wake or plateau for ease when entering and exiting a wake for improved tournament or recreational use. The hull herein described creates a softer center wake for increased buoyancy for the performer to slice thru the wake.

The drawings and specification disclose embodiments of the invention, and although specific terms are employed, the terms are used in a descriptive sense only and not for purposes of limitation. Further, it is understood that that various modifications and changes may be made within the spirit and scope of the invention without departing from the spirit and scope of the present invention as set forth in the appended claims.

That which is claimed is:

1. A boat hull comprising:

a port side reverse chine and a starboard side reverse chine displaced outboard a keel along port and starboard side portions of the hull, respectively, each chine extending from a forward portion of the hull to an aft portion thereof for inducing a lifting of a bow at generally low boat speeds and for providing a stabilizing effect thereto, wherein a desirable tracking capability of the hull is provided during a towing of a performer;

port and starboard spray pockets formed proximate aft portions of the port and starboard chines, respectively, at aft and outboard portions of the hull for reducing a side spray of water therefrom;

a plurality of strakes extending generally parallel to and at opposing outboard sides of the keel, wherein each of the plurality of strakes extends rearwardly toward the transom from proximate the spray pockets and from aft the port side and starboard side reverse chines for providing a lift to the hull, wherein each of the plurality of strakes begin aft a termination of the reverse chines so as to extend rearwardly; and a dispersion tunnel formed along the keel within an aft most portion of the hull, the dispersion tunnel extending through the transom for enhancing the lift and while reducing a center height dimension of a wake resulting from an operation of the hull.

2. A boat hull according to claim 1, further comprising a step formed at each of an aft portion of the port and starboard reverse chines and positioned proximate a forward portion of the spray pockets, the step having a termination for relieving pressure from the reverse chine so as to provide an improved spray pattern of the resulting wake.

3. A boat hull according to claim 1, wherein the plurality of strakes comprises port and starboard primary strakes having a first length dimension and port and starboard secondary strakes having a second length dimension, and wherein the second length dimension is less then the first length dimension.

4. A boat hull according to claim 3, wherein the primary strakes are positioned outboard the secondary strakes.

5. A boat hull according to claim 1, wherein a hull surface of the dispersion tunnel is generally defined by an elliptical cross section so as to provide a desired rooster tail and bump to a wake.

6. A boat hull according to claim 1, further comprising a strut extending therefrom for supporting a shaft, wherein an axis of the strut is rearwardly angled from a surface of the hull.

7. A boat hull according to claim 6, wherein the rearwardly angled strut includes the axis extending from the hull surface at approximately twelve degrees from perpendicular.

8. A boat hull according to claim 1, wherein aft most port and starboard portions of the hull are tapered inwardly toward the keel for providing a desired eddy currents resulting therefrom.

9. A boat hull according to claim 1, wherein the keel includes a generally sharpened bow portion for cutting into the water and directing flow thereof toward the starboard and port reverse chines.

10. A boat hull comprising:

a port side reverse chine and a starboard side reverse chine displaced outboard a keel along port and starboard side portions of the hull, respectively, each chine extending from a forward portion of the hull toward an a aft portion thereof for inducing a lifting of a bow at generally low boat speeds and for providing a stabilizing effect thereto, wherein a desirable tracking capability of the hull is provided during a towing of a performer;

a plurality of strakes extending generally parallel to and at opposing outboard sides of the keel, wherein each of the plurality of strakes extends from aft the port side and starboard side reverse chines and rearwardly toward the transom for providing a lift to the hull, wherein each of the plurality of strakes begin aft a termination of the reverse chines so as to extend rearwardly; and a dispersion tunnel formed along the keel within an aft most portion of the hull, the dispersion tunnel extending through the transom for enhancing the lift and while reducing a center height dimension of a wake resulting from an operation of the hull.

11. A boat hull according to claim 10, further comprising port and starboard spray pockets formed proximate the port and starboard chines, respectively, at an aft an outboard portion of the hull.

12. A boat hull according to claim 10, further comprising a step formed at each of an aft portion of the port and starboard reverse chines, the step having a termination for relieving pressure from the reverse chine so as to provide an improved spray pattern of the resulting wake.

13. A boat hull according to claim 10, wherein the plurality of strakes comprises port and starboard primary strakes, and wherein a length dimension of the primary strakes is greater than a length dimension of the secondary strakes.

14. A boat hull according to claim 13, wherein the primary strakes are positioned outboard the secondary strakes.

15. A boat hull according to claim 10, wherein the dispersion tunnel is defined by an elliptical cross section.

16. A boat hull according to claim 10, wherein aft most port and starboard portions of the hull are tapered inwardly toward the keel.

17. A boat hull comprising:

a port side reverse chine and a starboard side reverse chine displaced outboard a keel along port and starboard side portions of the hull, respectively, each chine extending from a forward portion of the hull to an aft portion thereof for inducing a lifting of a bow at generally low boat speeds and for providing a stabilizing effect thereto, wherein a desirable tracking capability of the hull is provided during a towing of a performer;

port and starboard spray pockets formed within a generally horizontal portion of the hull and proximate aft portions of the port and starboard reverse chines, respectively, at an aft an outboard portion of the hull for reducing a side spray of water therefrom, wherein the spray pockets are laterally inwardly disposed with respect to inner longitudinal edges of respective chines, and wherein the spray pockets are positioned entirely in a vertically spaced relation relative to the respective chines; and a dispersion tunnel formed along the keel within an aft most portion of the hull, the dispersion tunnel extending through the transom for enhancing the lift and while reducing a center height dimension of a wake resulting from an operation of the hull.

18. A boat hull according to claim 17, further comprising a plurality of strakes extending generally parallel to and at opposing outboard sides of the keel, wherein each of the plurality of strakes extends from aft the port side and starboard side reverse chines proximate the spray pockets and rearwardly toward the transom for providing a lift to the hull.

19. A boat hull according to claim 18, wherein the plurality of strakes comprises port and starboard primary strakes having a first length dimension and port and starboard secondary strakes having a second length dimension, and wherein the second length dimension is less then the first length dimension.

20. A boat hull according to claim 18, further comprising a step formed at each of an aft portion of the port and starboard reverse chines and positioned proximate a forward portion of the spray pockets, the step having a termination for relieving pressure from the reverse chine so as to provide an improved spray pattern of the resulting wake.

21. A boat hull according to claim 17, wherein a hull surface of the dispersion tunnel is generally defined by an elliptical cross section so as to provide a desired rooster tail and bump to a wake.

22. A boat hull according to claim 17, wherein aft most port and starboard portions of the hull are tapered inwardly toward the keel for providing a desired eddy currents resulting therefrom.

23. A boat hull according to claim 17, wherein aft most port and starboard portions of the hull are tapered inwardly toward the keel.

* * * * *